US006523979B1

(12) United States Patent
Kawata et al.

(10) Patent No.: US 6,523,979 B1
(45) Date of Patent: Feb. 25, 2003

(54) LIGHTING DEVICE

(75) Inventors: Sosaku Kawata, Kanuma (JP); Hiroshi Ishihata, Sendai (JP)

(73) Assignee: Nakanishi, Inc., Tochigi-ken (JP)

( * ) Notice: Subject to any disclaimer, the term of this patent is extended or adjusted under 35 U.S.C. 154(b) by 0 days.

(21) Appl. No.: 09/679,920

(22) Filed: Oct. 5, 2000

(30) Foreign Application Priority Data

Feb. 9, 1999 (JP) ..... 11-031261
Feb. 8, 2000 (WO) ..... PCT/JP00/00670

(51) Int. Cl.[7] ..... F21V 29/00

(52) U.S. Cl. ..... 362/294; 362/235; 362/245; 362/293; 362/310; 362/373; 362/800

(58) Field of Search ..... 362/230, 231, 362/235, 234, 247, 293, 294, 373, 800, 310, 311, 244, 245

(56) References Cited

U.S. PATENT DOCUMENTS 3,596,125 A * 7/1971 Seigel ..... 362/318
5,224,773 A * 7/1993 Arimura ..... 362/227
5,707,139 A * 1/1998 Haitz ..... 362/231
5,890,794 A * 4/1999 Abtahi et al. ..... 362/294
5,997,150 A * 12/1999 Anderson ..... 362/227
6,200,134 B1 * 3/2001 Kovac et al. ..... 362/800

FOREIGN PATENT DOCUMENTS

| | | |
|---|---|---|
| JP | 55-8909 | 1/1980 |
| JP | 3-77674 | 12/1991 |
| JP | 10144964 | 5/1998 |
| JP | 10165423 | 6/1998 |
| JP | 10208521 | 8/1998 |
| JP | 19233534 | 9/1998 |

* cited by examiner

*Primary Examiner*—Alan Cariaso
(74) *Attorney, Agent, or Firm*—Crosby, Heafey, Roach & May

(57) ABSTRACT

A lighting device having a safe, long-life, and low-cost light source, is disclosed which has a composite element including a plurality of LEDs arranged in rows and columns.

5 Claims, 2 Drawing Sheets

LIGHTING DEVICE

FIELD OF ART

The present invention relates to a lighting device, in particular a lighting device that may be applied to a shadowless lamp or a portable lighting unit useful in dental or surgical diagnosis.

BACKGROUND ART

In dental and surgical diagnosis, shadowless lamps are commonly used for casting appropriate light on and around a working site. For a light source of shadowless lamps, halogen lamps have conventionally been used. The halogen lamps, however, generate heat when electric current flows through the filament, such that the surface temperature of the lamps rises to as high as 200 to 300° C., thereby having problems in safety. Such calefacient light also discomforts the patients and doctors. Further, the halogen lamps are not resistant to vibration, short in service life, and expensive.

There has not been known a composite element wherein light emitting diodes are arranged in rows and columns for a lighting purpose.

DISCLOSURE OF THE INVENTION

It is an object of the present invention to provide a lighting device having a light source that is safe, long-life, and low-cost.

According to the present invention, there is provided a lighting device comprising a composite element having a plurality of light emitting diodes arranged in rows and columns.

The composite element is in the form of a plate composed of a plurality of light emitting diodes (referred to as "LEDs" hereinbelow) arranged in rows and columns. The shape of the plate is not particularly limited, and may be circular, oval, or polygonal such as rectangular shape. The composite element, compared to the halogen lamps, provides a higher light transforming rate and thus a remarkably less heat release value, thus being safe. In addition, the composite element is free of filaments, which structure results in high impact-resistance and long service life, and realizes light emission at low voltage and current, thus being advantageous in cost.

The lighting device of the present invention may further have heat removing means for removing heat generated by the composite element, and light controlling means for controlling the light paths of the LEDs.

The heat removing means removes the uncomfortable feeling of heat given by the light rays emitted by the LEDs. Examples of the heat removing means for this application include a layer having an infra-red cut-out layer for cutting out at least a portion of the infra-red rays of the light emitted by the LEDs, and a liquid cooling agent for cooling the surface of the LEDs of the composite element. The layer having an infra-red cut-out layer may preferably be a radiator plate that transmits only the infra-red rays, or a special coating that absorbs the infra-red rays. The cooling agent may preferably be a silicon oil.

The lighting device of the present invention may further be provided with a reflector that reflects the light rays emitted by the LEDs of the composite element in the direction of the irradiation. With such a reflector, the present lighting device can be used as a shadowless lamp.

PREFERRED EMBODIMENTS OF THE INVENTION

Preferred embodiments of the present invention will now be explained with reference to the attached drawings.

Figure 1:
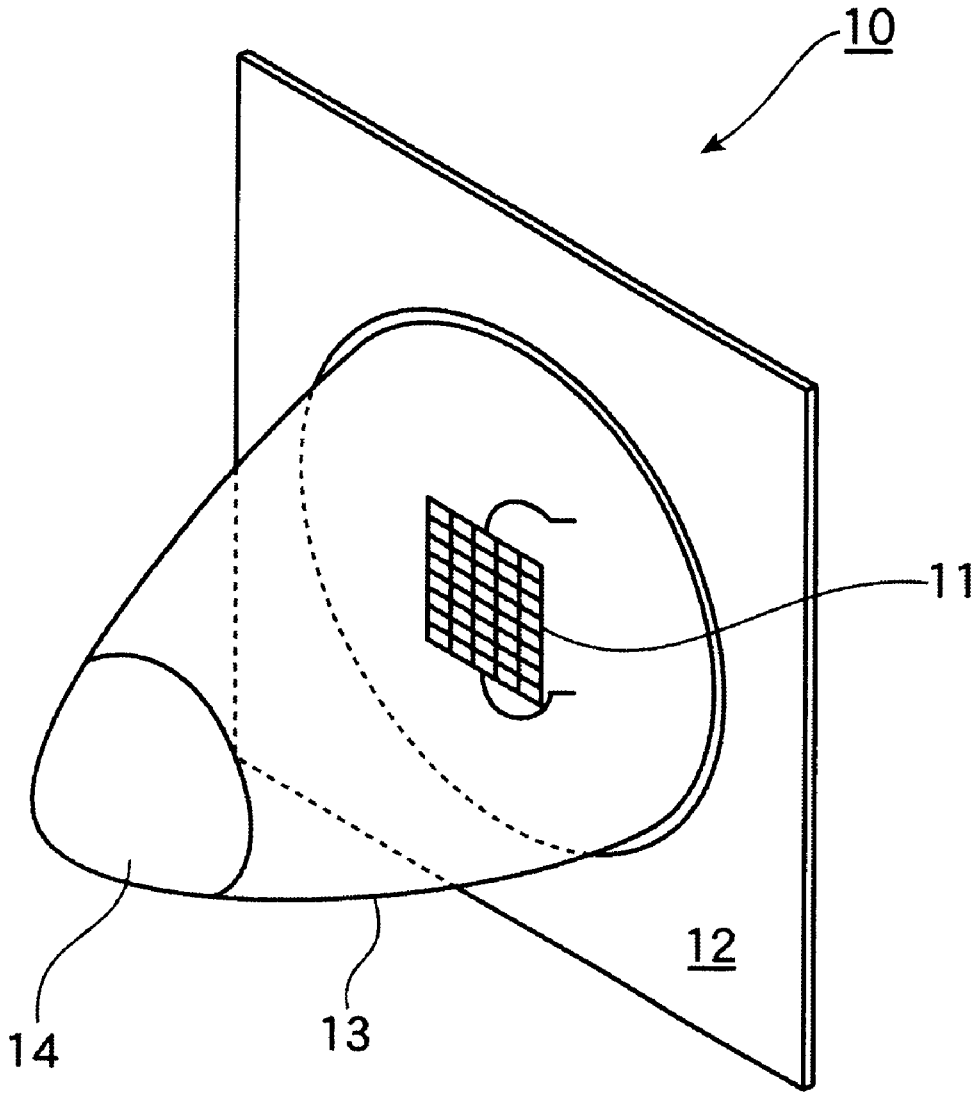
FIG. 1 is a schematic explanatory view of the lighting device of the present invention.

FIG. 1 is a schematic explanatory view of a lighting device 10 according to the present invention. The lighting device 10 includes a composite element 11 having a plurality of LEDs as a light source, a radiator plate 12 carrying the composite element 11 in the center of its surface, a transparent casing 13 generally in the form of a conical cup projecting from the front surface of the radiator plate 12 and encasing the composite element 11 therein, and an aspheric lens 14 provided in the tip portion of the transparent casing 13 and functioning as light controlling means. The transparent casing 13 is sealingly filled with about 40 cc of a silicon oil as a cooling agent, and the transparent casing 13 and the radiator plate 12 are sealed to each other in a water-tight manner.

The composite element 11 has forty LEDs arranged in eight rows of five LEDs each. The electric power consumption of the element 11 is 3.2 W (3.2 V×1 A) The radiator plate 12 is designed so as to transmit rearward through the plate 12 the infra-red rays of the light emitted by the LEDs of the composite element 11 and to reflect the visible light rays forward. The aspheric lens 14 is capable of controlling the light paths as desired.

The heat release value of the composite element 11, when the LEDs are on, is such that one can touch the element 11 with its hands to feel hot, and is remarkably lower than that of the halogen lamps. The light rays emitted by the composite element 11 give uncomfortable feeling of heat. Such feeling of heat is, however, mitigated by placing the composite element 11 in contact with the silicon oil acting as a cooling agent sealingly contained in the transparent casing 13, to lower the surface temperature of the composite element 11 to about 40° C. The uncomfortable feeling of heat is further removed effectively by the radiator plate 12 dissipating the infra-red rays emitted by the composite element. In the example shown in FIG. 1, the radiator plate 12 and the silicon oil constitute the heat removing means.

Figure 2:
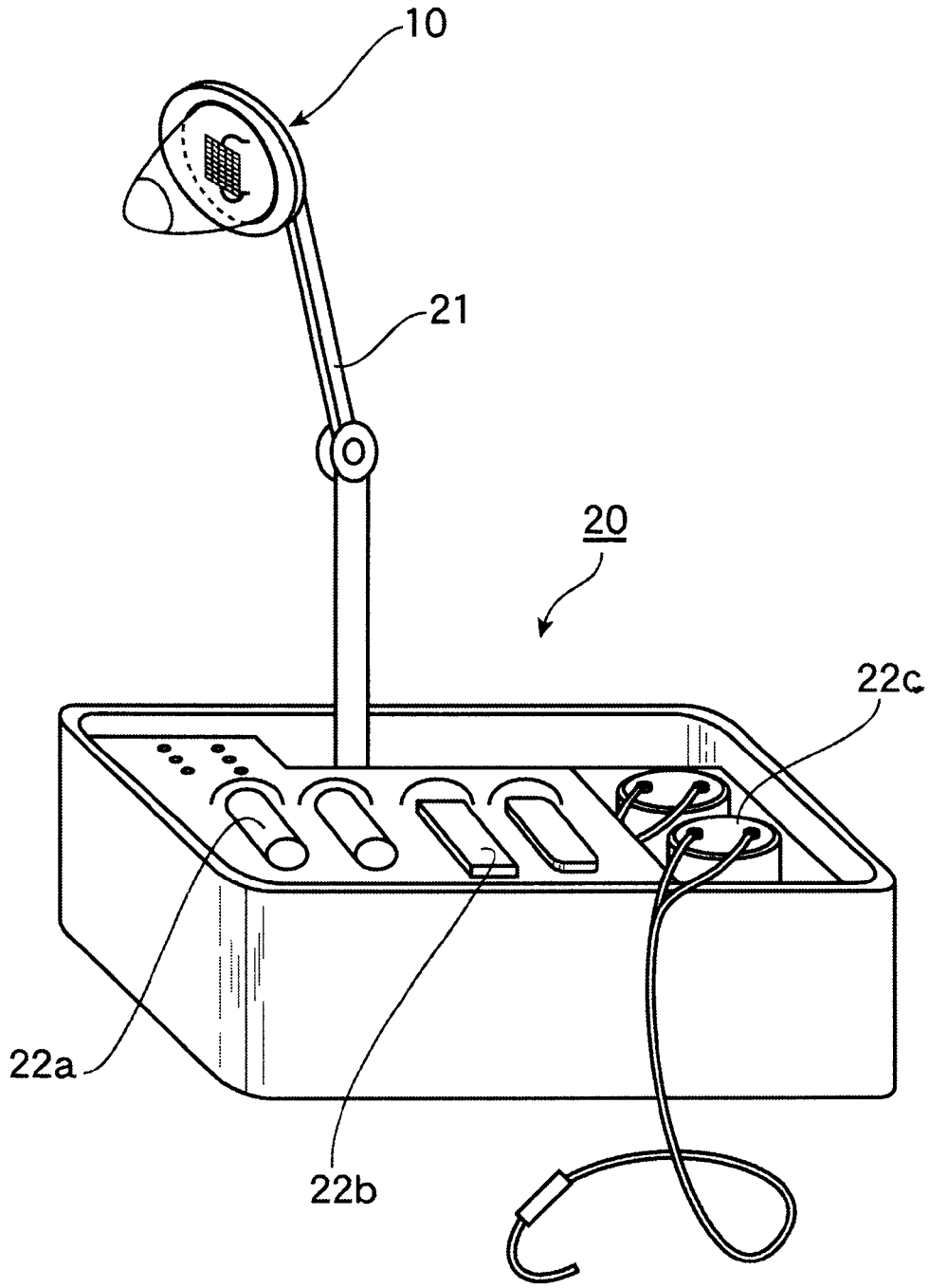
FIG. 2 is a schematic view of a portable case that accommodates medical instruments and equipped with the lighting device of the present invention.

In use, the lighting device 10 may be mounted on a suitable stand or arm. For example, the lighting device 10 may be mounted for use on an arm 21 attached to a portable case 20 for accommodating medical instruments (22*a*–22*c*) as shown in FIG. 2.

When the lighting device 10 is used as a shadowless lamp, the radiator plate 12 is replaced with a reflector (not shown). The reflector is composed of a combination of special parabolic surfaces and corrugated curves designed to give light condensing and shadowless effects, and reflects more than 90% of the visible light rays. Incidentally, the reflector may be provided on its rear surface with a special coating capable of absorbing the infra-red rays, to make the reflector function also as a radiator plate.

As discussed hitherto, use of the composite element including a plurality of LEDs as a light source provides the lighting device of the present invention with remarkably improved safety, durability, and economic efficiency, compared to the conventional lighting devices employing halogen lamps as a light source.

What is claimed is:

1. A lighting device comprising:

as a light source, a composite element having a plurality of light emitting diodes arranged in rows and columns;

heat removing means for removing heat generated by said, composite element, said heat removing means comprising a liquid cooling agent for contacting and cooling a surface of said composite element, and a layer having an infra-red cut-out layer for cutting out at least a portion of infra-red rays in light emitted by said composite element; and light controlling means for controlling a path of light emitted by said composite element.

2. The lighting device of claim 1 wherein said cooling agent is a silicon oil.

3. The lighting device of claim 1 further comprising a reflector for reflecting light rays emitted by said composite element back in a direction of irradiation.

4. The lighting device of claim 1, further comprising a transparent casing generally in the form of a conical cup encasing the composite element.

5. The lighting device of claim 4, wherein said light controlling means comprises an aspheric lens provided in a tip portion of said transparent casing.

* * * * *

UNITED STATES PATENT AND TRADEMARK OFFICE

CERTIFICATE OF CORRECTION

PATENT NO. : 6,523,979 B1 
DATED : February 25, 2003
INVENTOR(S) : Sosaku Kawata and Hiroshi Ishihata It is certified that error appears in the above-identified patent and that said Letters Patent is hereby corrected as shown below:

Title page,
Below item [22], the following information should be inserted:

-- Related U.S. Application Priority Data
[63] Continuation of application No. PCT/JP00/00670, filed on Feb. 8, 2000 --
Item [30], the line which reads "Feb. 8, 2000 (WO) . . . . PCT/JP00/00670" should be deleted.

Column 1,
Line 3, after the title of the invention, the following paragraph should be added:

-- Cross-Reference to Related Applications and Claim of Priority
This is a continuation of International Application PCT/JP00/00670, with an international filing date of Feb. 8, 2000, which was not published in English under PCT Article 21(2); and claims priority to Japanese Patent Application No. 11-031261, filed Feb. 9, 1999. --

Signed and Sealed this

Seventh Day of October, 2003

JAMES E. ROGAN
*Director of the United States Patent and Trademark Office*